US005439183A

United States Patent [19]

Virving

[11] Patent Number: 5,439,183

[45] Date of Patent: Aug. 8, 1995

[54] REFINER SEGMENT

[75] Inventor: Nils G. Virving, Hässelby, Sweden

[73] Assignee: Sunds Defibrator Industries Aktiebolag, Sweden

[21] Appl. No.: 365,065

[22] Filed: Dec. 28, 1994

Related U.S. Application Data

[63] Continuation of Ser. No. 116,403, Sep. 3, 1993, abandoned.

[30] Foreign Application Priority Data

Jun. 17, 1993 [SE] Sweden ..... 9302092

[51] Int. Cl.[6] ..... B02C 7/12

[52] U.S. Cl. ..... 241/296; 241/261.3

[58] Field of Search ..... 241/253, 261.2, 261.3, 241/296

[56] References Cited

U.S. PATENT DOCUMENTS

| | | | |
|---|---|---|---|
| 1,131,272 | 3/1915 | Reynolds | 241/296 |
| 3,674,217 | 7/1972 | Reinhall | 241/296 X |
| 4,676,440 | 6/1987 | Perkola | 241/261.3 |

*Primary Examiner*—Douglas D. Watts

*Attorney, Agent, or Firm*—Lerner, David, Littenberg, Krumholz & Mentlik

[57] ABSTRACT

Refiner segments for use in disk refiners for the disintegration of lignocellulose-containing material are disclosed, in which the refiner segment is formed with a pattern of bars and grooves and includes dams placed in the grooves. The dams are arranged so that their angle in relation to the radius of the refiner segment is less than about 30°, preferably less than about 15°.

4 Claims, 1 Drawing Sheet

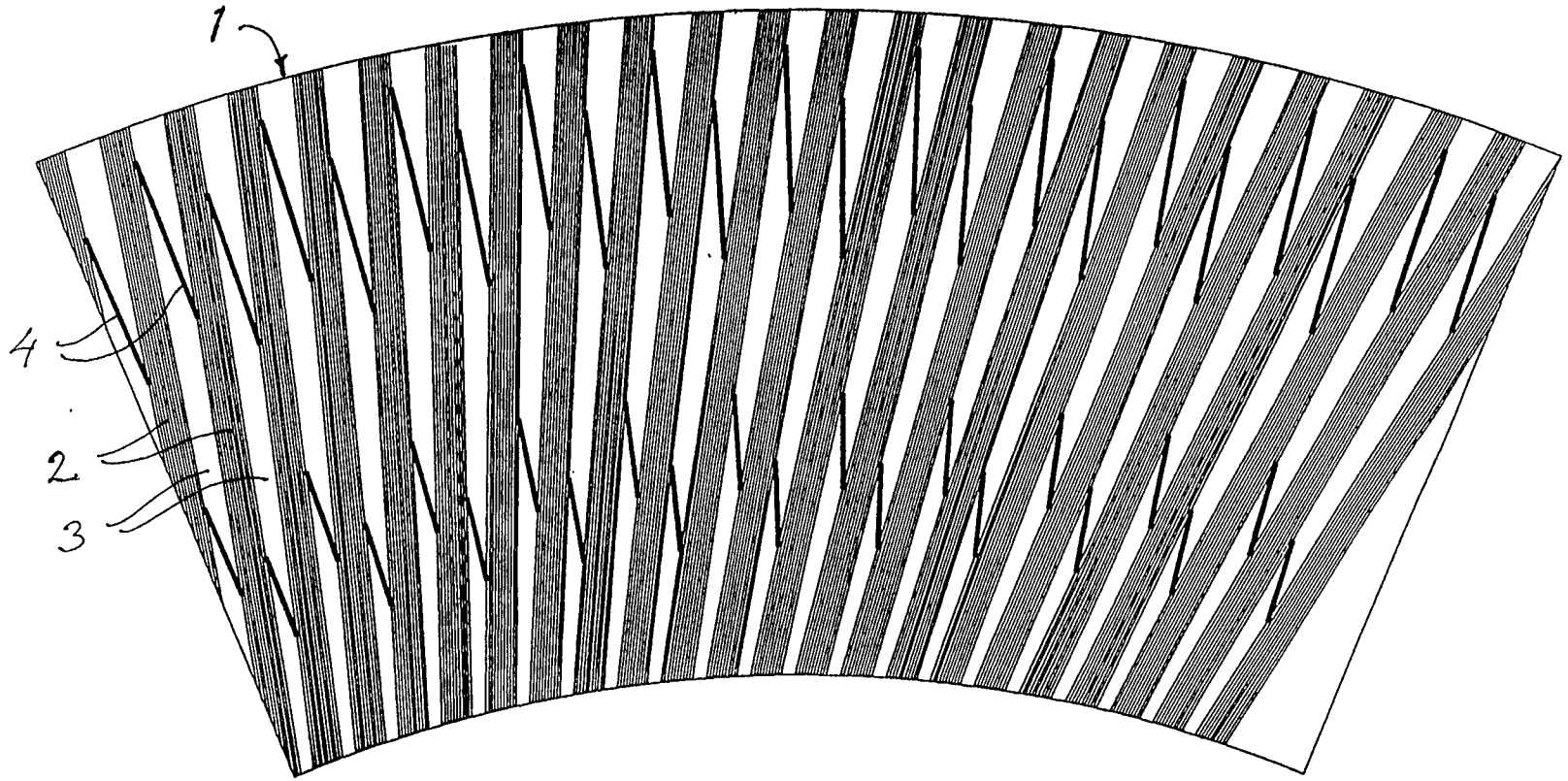
1
4
2
3

REFINER SEGMENT

This is a continuation of application Ser. No. 08/116,403 filed Sep. 3, 1993, now abandoned.

FIELD OF THE INVENTION

The present invention relates to refiner segments. More particularly, the present invention relates to refiner segments for use in disk refiners for the disintegration of lignocellulose-containing fibrous material.

BACKGROUND OF THE INVENTION

It is well known that disk refiners comprise two opposed refining disks, one or both of which can be rotatably mounted. A plurality of refiner segments are arranged on these refining disks and are generally formed with a pattern of alternating bars and intermediate grooves therebetween. These refining disks are arranged such that the refiner segments form a refining gap, through which the fibrous material is passed so that it can be disintegrated by the bars on the individual segments.

The bars and grooves of these refiner segments normally extend substantially radially, but can also be arranged more or less obliquely in relation to the radius of the segments. The pattern of these bars and grooves can also be divided into zones located outwardly circumferentially from each other and having different types of bars thereon in such zones.

It has been found to be advantageous, especially during disintegration of fibrous material having a high concentration, to place flow restrictions, such as so-called "dams," across the grooves in the refiner segments in order to prevent untreated material from passing outwardly through the refining gaps. These dams tend to force the material upwardly out of the grooves, so that it can then be subjected to treatment between the bars on the refiner segments on opposing refining disks.

In those plants where the fibrous raw material contains significant amounts of sand and other impurities, the bars on the refiner segments can be worn out prematurely. This takes place, in particular, in plants where fiberboard is being manufactured.

When the refiner segments are provided with dams, the wear generally concentrates on the bars about these dams. It has also been found that the dams are not worn to the same degree as the bars about them, and the dams will therefore project above the bars on the refiner segments, which can result in their coming into contact with and wearing down the bars on the refiner segments on the opposed refining disks. The refiner segments are thus subjected to much stronger wear, resulting in an unacceptably short service life for the refiner segments.

In order to overcome these problems, it has become necessary in certain cases to install rather expensive equipment, for the removal of the sand or other material prior to the disk refiner to the greatest possible extent. Alternatively, refiner segments have been used without dams. In these cases, however, additional steps must be taken to deal with the reduced quality of the finally distributed material, such as by refining in several steps.

SUMMARY OF THE INVENTION

In accordance with the present invention, the solution for the aforementioned problems has now been devised without creating additional drawbacks. Thus, according to this invention, the dams are so arranged in the grooves that their angle in relation to the radius of the refiner segment is smaller than about 30°, and preferably smaller than about 15°.

Thus, in accordance with the present invention, applicant has invented a refiner segment for use in disk refiners for the treatment of a lignocellulose-containing material which refiner segment has a radius and includes an upper surface, an alternating pattern of pluralities of bars extending upwardly from the upper surface of the refiner segment, intermediate grooves therebetween, and dam means extending upwardly from the refiner surface at a predetermined angle of less than about 30° with respect to the radius of the refiner segment. Preferably, the dam means extends upwardly from the refiner segment at a predetermined angle of less than about 15°.

In accordance with one embodiment of the refiner segment of the present invention, the dam means includes a plurality of individual dam members located in each of the intermediate grooves. In a preferred embodiment, the plurality of individual dam members comprises a first plurality of individual dam members in the intermediate grooves, and the refiner segment includes a second plurality of individual dam members located in the intermediate grooves radially inwardly from said first plurality of individual dam members.

In accordance with one embodiment of the refiner segments of the present invention, the plurality of bars extend obliquely with respect to the radius of the refiner segment.

By utilizing the refiner segments in accordance with the present invention, and in particular, the arrangement of the dams thereon, the wear will be more uniform, and the service life of the refiner segment thereby increases significantly.

BRIEF DESCRIPTION OF THE DRAWINGS

The present invention may be more fully understood with reference to the following detailed description, which refers to the Figure, in which:

The Figure is a top projection view of a refiner segment in accordance with the present invention.

DETAILED DESCRIPTION

Referring to the Figure, the refiner segment 1 shown therein is formed with a pattern of bars 2 and grooves 3, which are arranged obliquely in relation to the radius of the refiner segment. In particular locations in the grooves 3, dams 4 are provided and arranged substantially radially with respect to the radius of the refiner segment.

The deviation of the dams from the radius of the refiner segment should be less than 15°, but depending upon the configuration of the pattern of the refiner segment, also slightly greater deviations can be imagined, possibly up to an angle of less than about 30°.

Suitable dimensions for the pattern of the refiner segments can include a bar width of between about 1 and 4 millimeters, a groove with between about 2 and 12 millimeters, and a bar height of between about 4 and 15 millimeters. The dams themselves should extend upwardly to the level of the bar tops.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A refiner segment for use in disk refiners for the treatment of lignocellulose-containing materials, said refiner segment having a radius and including an upper surface, an alternating pattern of pluralities of bars extending upwardly from said upper surface of said refiner segment to a predetermined bar height, and intermediate grooves having a predetermined groove width therebetween, and a plurality of dam members disposed in said intermediate grooves and extending upwardly from said upper surface of said refiner segment to said predetermined bar height, each of said dam members being arranged at a predetermined angle of less than about 30° with respect to said radius of said refiner segment, said dam members extending across said entire predetermined groove width of said intermediate grooves at said predetermined bar height.

2. The refiner segment of claim 1 wherein said dam members extend upwardly from said refiner surface at a predetermined angle of less than about 15°.

3. The refiner segment of claim 1 wherein said plurality of dam members comprises a first plurality of dam members, and including a second plurality of dam members located in each of said intermediate grooves radially inwardly with respect to said first plurality of dam members.

4. The refiner segment of claim 1 wherein said pluralities of bars extend obliquely with respect to said radius of said refiner segment.

* * * * *